US005879005A

United States Patent [19]

Baca

[11] Patent Number: 5,879,005

[45] Date of Patent: Mar. 9, 1999

[54] WARGAME PLAYING SYSTEM

[76] Inventor: Ron Baca, 8145 E. Camelback Rd. #126, Scottsdale, Ariz. 85251

[21] Appl. No.: 31,470

[22] Filed: Feb. 26, 1998

[51] Int. Cl.[6] ..... A63F 3/00

[52] U.S. Cl. ..... 273/255

[58] Field of Search ..... 273/242, 243, 273/255, 262, 256, 278

[56] References Cited

U.S. PATENT DOCUMENTS

| | | | |
|---|---|---|---|
| 2,464,819 | 3/1949 | Lieberman | 273/262 |
| 2,799,504 | 7/1957 | Keyko | 273/262 X |
| 3,343,841 | 9/1967 | Arend | 273/262 |
| 4,373,731 | 2/1983 | Whiteman et al. | 273/262 |
| 4,415,160 | 11/1983 | Lamb | 273/255 X |
| 5,570,887 | 11/1996 | Christie, Jr. | 273/262 X |

*Primary Examiner*—William E. Stoll

[57] ABSTRACT

The inventive device includes a game board having an playing surface illustrated to represent terrain and having a plurality of spaces, each space having a type of terrain represented therein. A plurality of gold playing coins and a plurality of silver playing coins are provided. A plurality of playing piece sets are provided, each set including: a ruler piece, a queen piece, a plurality of soldier pieces. Each piece of the playing piece set is assigned an associated coin value, the coin values determining the number of playing coins required to purchase its respective piece of the playing piece set. A plurality of siege pieces are also provided and include catapults, a battering ram, an assault tower, and a bridge. The system includes a plurality of dice which are divided into a number of dice sets.

10 Claims, 8 Drawing Sheets

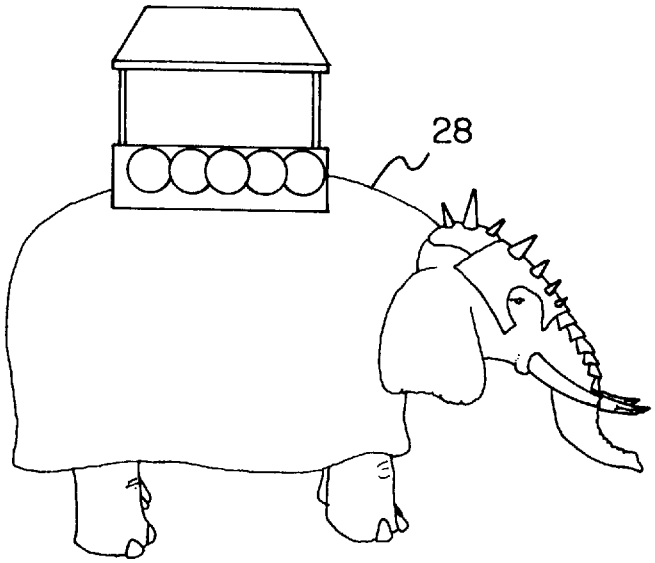
FIG. 12
FIG. 13
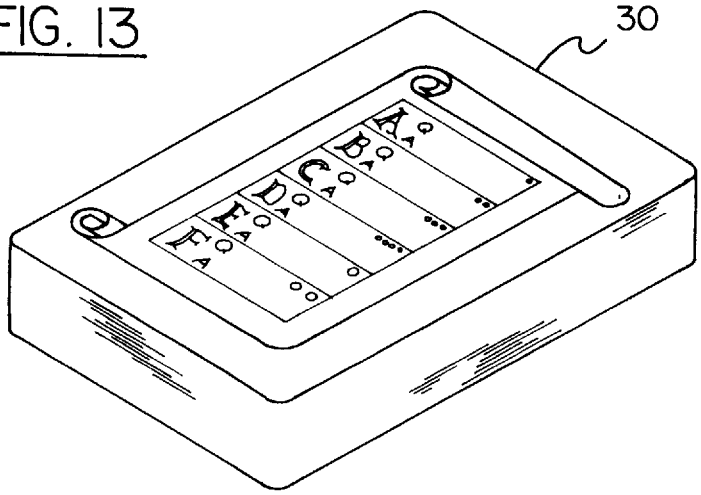

FIG. 16
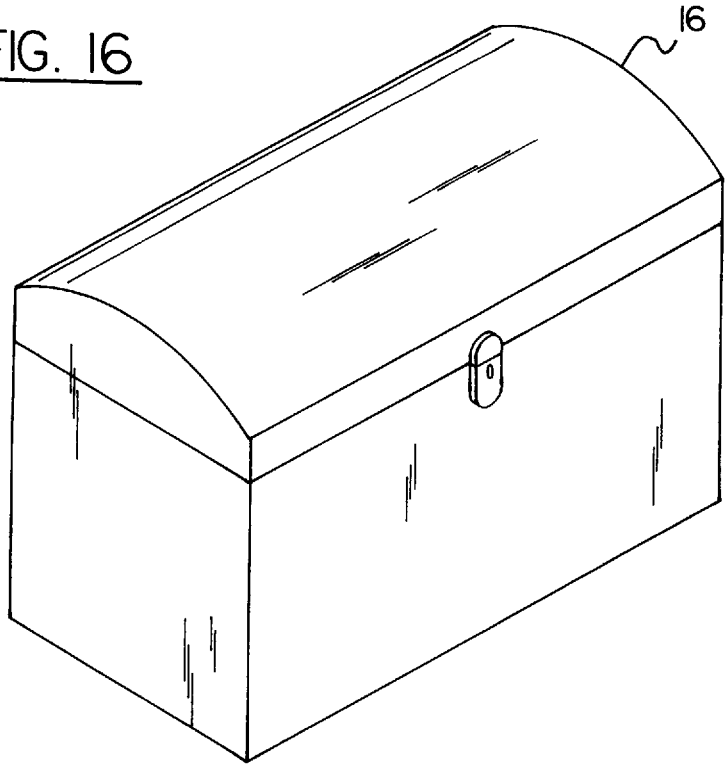
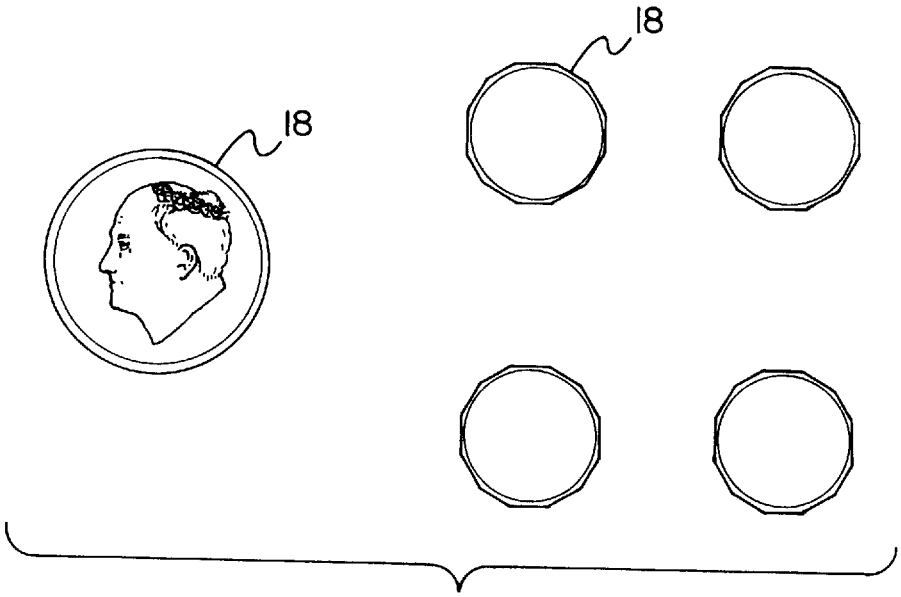
FIG. 17

WARGAME PLAYING SYSTEM

BACKGROUND OF THE INVENTION

1. Field of the Invention

The present invention relates to war games and more particularly pertains to a new wargame playing system for providing a game of skill, knowledge of history, and fun.

2. Description of the Prior Art

The use of war games is known in the prior art. More specifically, war games heretofore devised and utilized are known to consist basically of familiar, expected and obvious structural configurations, notwithstanding the myriad of designs encompassed by the crowded prior art which have been developed for the fulfillment of countless objectives and requirements.

Known prior art war games include U.S. Pat. No. 5,437,460; U.S. Pat. No. 5,570,887; U.S. Pat. No. 4,415,160; and U.S. Pat. No. 4,227,695.

While these devices fulfill their respective, particular objectives and requirements, the aforementioned patents do not disclose a new wargame playing system. The inventive device includes a game board having an playing surface is illustrated to represent terrain and having a plurality of spaces, each the space having a type of terrain represented therein. A plurality of gold playing coins and a plurality of silver playing coins are provided. A plurality of playing piece sets are provided, each set including: a ruler piece, a queen piece, a plurality of soldier pieces. Each piece of the playing piece set is assigned an associated coin value, the coin values determining the number of playing coins required to purchase its respective piece of the playing piece set. A plurality of siege pieces are also provided and include catapults, a battering ram, an assault tower, and a bridge. The system includes a plurality of dice which are divided into a number of dice sets including: a movement set of dice for determining the movement of a piece of the playing sets; a defender damage set of dice for determining the amount of damage sustained by a piece of the playing set designated as a defender; an attacker damage set of dice for determining the amount of damage sustained by a piece of the playing set designated as an attacker; a weather set of dice for representing a number of types of weather, each of the weathers affecting the movement of the pieces of the playing piece sets; a bonus die for determining the amount of bonus during a combat; a silver die for determining the number of silver playing coins a player will receive; and a gold die for determining the number of gold playing coins a player will receive.

In these respects, the wargame playing system according to the present invention substantially departs from the conventional concepts and designs of the prior art, and in so doing provides an apparatus primarily developed for the purpose of providing a game of skill, knowledge of history, and fun.

SUMMARY OF THE INVENTION

In view of the foregoing disadvantages inherent in the known types of war games now present in the prior art, the present invention provides a new wargame playing system construction wherein the same can be utilized for providing a game of skill, knowledge of history, and fun.

The general purpose of the present invention, which will be described subsequently in greater detail, is to provide a new wargame playing system apparatus and method which has many of the advantages of the war games mentioned heretofore and many novel features that result in a new wargame playing system which is not anticipated, rendered obvious, suggested, or even implied by any of the prior art war games, either alone or in any combination thereof.

To attain this, the present invention generally comprises a game board having an playing surface is illustrated to represent terrain and having a plurality of spaces, each the space having a type of terrain represented therein. A plurality of gold playing coins and a plurality of silver playing coins are provided. A plurality of playing piece sets are provided, each set including: a ruler piece, a queen piece, a plurality of soldier pieces. Each piece of the playing piece set is assigned an associated coin value, the coin values determining the number of playing coins required to purchase its respective piece of the playing piece set. A plurality of siege pieces are also provided and include catapults, a battering ram, an assault tower, and a bridge. The system includes a plurality of dice which are divided into a number of dice sets including: a movement set of dice for determining the movement of a piece of the playing sets; a defender damage set of dice for determining the amount of damage sustained by a piece of the playing set designated as a defender; an attacker damage set of dice for determining the amount of damage sustained by a piece of the playing set designated as an attacker; a weather set of dice for representing a number of types of weather, each of the weathers affecting the movement of the pieces of the playing piece sets; a bonus die for determining the amount of bonus during a combat; a silver die for determining the number of silver playing coins a player will receive; and a gold die for determining the number of gold playing coins a player will receive.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wargame playing system apparatus and method which has many of the advantages of the war games mentioned heretofore and many novel features that result in a new wargame playing system which is not anticipated, rendered obvious, suggested, or even implied by any of the prior art war games, either alone or in any combination thereof.

It is another object of the present invention to provide a new wargame playing system which may be easily and efficiently manufactured and marketed.

It is a further object of the present invention to provide a new wargame playing system which is of a durable and reliable construction.

An even further object of the present invention is to provide a new wargame playing system which is susceptible of a low cost of manufacture with regard to both materials and labor, and which accordingly is then susceptible of low prices of sale to the consuming public, thereby making such wargame playing system economically available to the buying public.

Still yet another object of the present invention is to provide a new wargame playing system which provides in the apparatuses and methods of the prior art some of the advantages thereof, while simultaneously overcoming some of the disadvantages normally associated therewith.

Still another object of the present invention is to provide a new wargame playing system for providing a game of skill, knowledge of history, and fun.

Yet another object of the present invention is to provide a new wargame playing system which includes a game board having an playing surface is illustrated to represent terrain and having a plurality of spaces, each the space having a type of terrain represented therein. A plurality of gold playing coins and a plurality of silver playing coins arc provided. A plurality of playing piece sets are provided, each set including: a ruler piece, a queen piece, a plurality of soldier pieces. Each piece of the playing piece set is assigned an associated coin value, the coin values determining the number of playing coins required to purchase its respective piece of the playing piece set. A plurality of siege pieces are also provided and include catapults, a battering ram, an assault tower, and a bridge. The system includes a plurality of dice which are divided into a number of dice sets including: a movement set of dice for determining the movement of a piece of the playing sets; a defender damage set of dice for determining the amount of damage sustained by a piece of the playing set designated as a defender; an attacker damage set of dice for determining the amount of damage sustained by a piece of the playing set designated as an attacker; a weather set of dice for representing a number of types of weather, each of the weathers affecting the movement of the pieces of the playing piece sets; a bonus die for determining the amount of bonus during a combat; a silver die for determining the number of silver playing coins a player will receive; and a gold die for determining the number of gold playing coins a player will receive.

Still yet another object of the present invention is to provide a new wargame playing system that is designed not only as a game, but as a toy, action figures, dolls and as an educational tool, for ages 5 years and up as well as for both males and females alike. The wargame playing system can be used in many different ways. For example, playing the game, playing with them as action figures, collecting as collectibles, and to set up as a model to reenact historical battles.

Even still another object of the present invention is to provide a new wargame playing system that brings together the great leaders of their times and allows you to interact armies and people from different times as you are in command and control their destiny. This system allow a player to imagine that they are leading their armies with historical figures such as Alexander the Great and Ghengis Khan.

The wargame playing system has several different levels of difficulty. The easiest is to simply set the armies up and fire your catapults and launchers at each other's armies and see who can knock down each other's army first. The other levels add more complexities in play as the players desire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 12 is a schematic view of a elephant soldier playing piece of the present invention.

FIG. 13 is a schematic perspective view of a set of quest cards of the present invention.

FIG. 16 is a schematic perspective view of the treasure chest of the present invention.

FIG. 17 is a schematic side view of playing coins of the present invention.

DESCRIPTION OF THE PREFERRED EMBODIMENT

Figure 1:
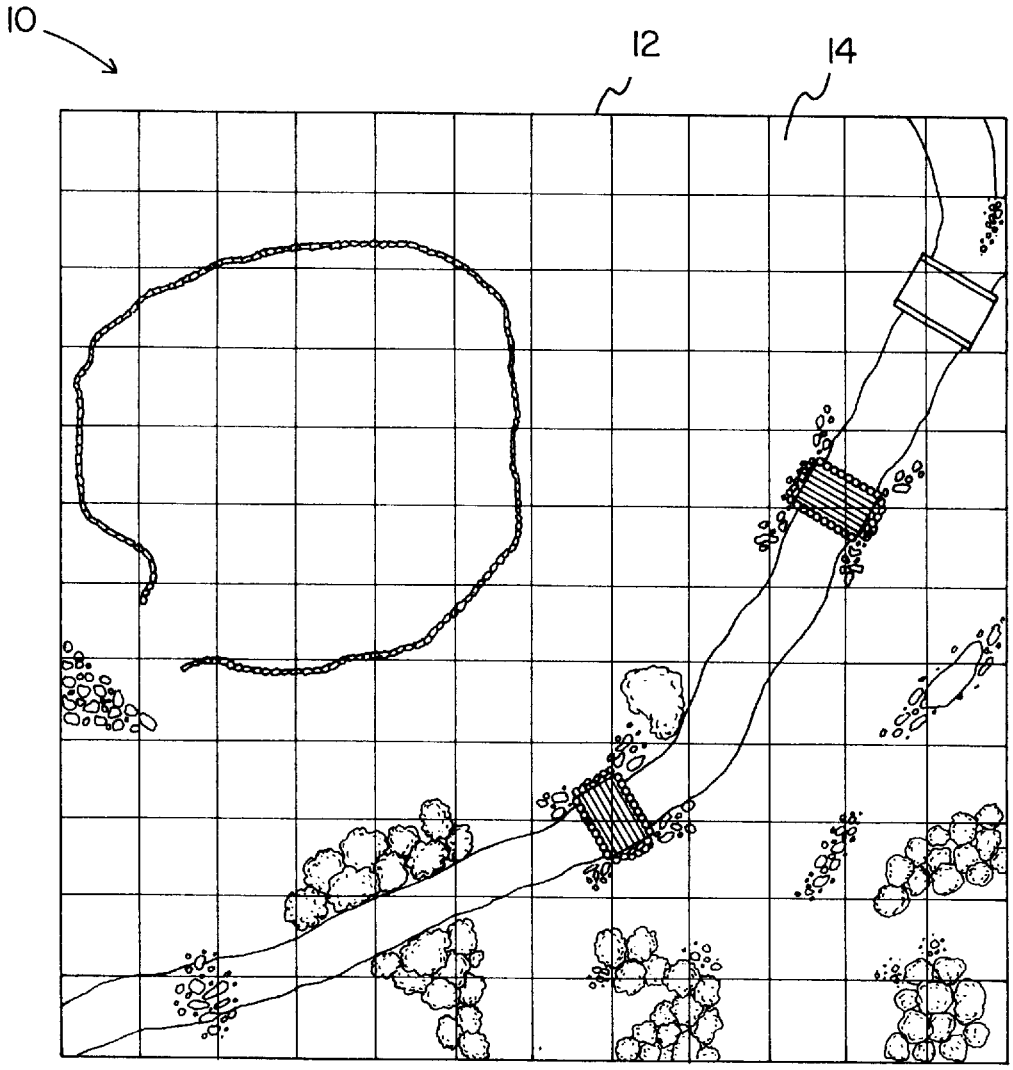
FIG. 1 is a schematic top side view of a game board of a new wargame playing system according to the present invention.
Figure 2:
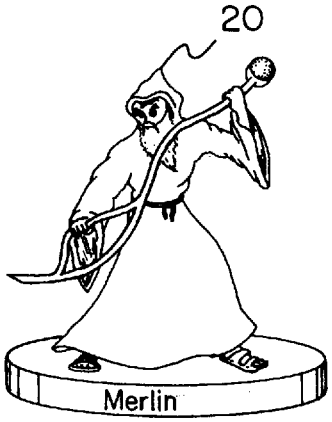
FIG. 2 is a schematic view a ruler of the present invention.

With reference now to the drawings, and in particular to FIGS. 1 through 19 thereof, a new wargame playing system embodying the principles and concepts of the present invention and generally designated by the reference numeral 10 will be described.

As best illustrated in FIGS. 1 through 19, the wargame playing system 10 generally comprises a game board 12 having an playing surface is illustrated to represent terrain and having a plurality of spaces 14, each the space having a type of terrain represented therein. A plurality of gold playing coins and a plurality of silver playing coins 18 are provided. A plurality of playing piece sets are provided, each set including: a ruler piece 20–27, a queen piece, a plurality of soldier pieces 36. Each piece of the playing piece set is assigned an associated coin value, the coin values determining the number of playing coins required to purchase its respective piece of the playing piece set. A plurality of siege pieces are also provided and include catapults 32, a battering ram, an assault tower 34, and a bridge. The system includes a plurality of dice 41–47 which are divided into a number of dice sets including: a movement set of dice 41 for determining the movement of a piece of the playing sets; a defender damage set of dice 42 for determining the amount of damage sustained by a piece of the playing set designated as a defender; an attacker damage set of dice 43 for determining the amount of damage sustained by a piece of the playing set designated as an attacker; a weather set of dice 44 for representing a number of types of weather, each of the weathers affecting the movement of the pieces of the playing piece sets; a bonus die 45 for determining the amount of bonus during a combat; a silver die 46 for determining the number of silver playing coins a player will receive; and a gold die 47 for determining the number of gold playing coins a player will receive.

In closer detail, the game board has an playing surface being illustrated to represent terrain and having a plurality of generally rectangular spaces being arranged in a grid fashion having a plurality of columns and rows. Each said space having a type of terrain represented therein. The game board or battlefield is made up of different terrain. Certain terrain may only be crossed or occupied by certain types of pieces. For example, chariots may not occupy or cross through the forest areas. Another examples is that forests may not be accessed by wheeled or animal driven pieces while rivers may be accessed by medium or light cavalry, rulers, queens, elite guards and small sea vessels, and elephants. A player may occupy each square with as many pieces as they wish but only as many that will fit in each square without overflowing into the next or adjoining space or spaces. This allows a player to strengthen their battle group and provide other pieces with a better defense.

A treasure chest 16 and a plurality of player chests are preferably provided for holding playing coins therein. The treasure chest is used to hold all the coins in the game as a bank. The player chests are used by each player for his or her coins to be placed in and kept throughout the game. The game also includes a plurality of gold playing coins and a plurality of silver playing coins. Each gold coin is worth a number of silver coins. These coins are used to buy player armies. Each player starts the game with a predetermined number of coins. The coins may also be used to pay ransom for captured pieces.

The playing pieces are divided into a number of playing piece sets. Each said playing piece set includes a ruler piece, a queen piece, and a plurality of soldier pieces. Each type of piece is assigned a coin value that is used to determine their purchasing cost and their combat value. FIGS. 2 through 9 illustrate various king pieces that may be included in the game system. The soldier pieces include infantry pieces, cavalry pieces, chariot pieces (FIG. 19), archer pieces, and elephant pieces 26 (FIG. 12). Preferably, a plurality of siege pieces are provided as playing pieces and include catapults (FIG. 10), a battering ram (FIG. 11), an assault tower, and a bridge.

Figure 3:
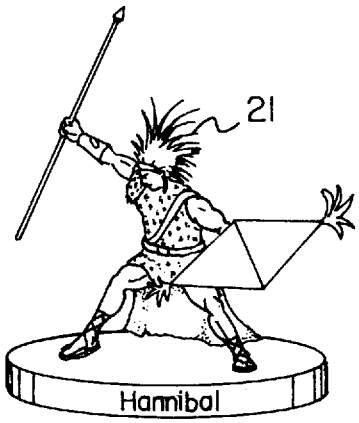
FIG. 3 is a schematic view a ruler of the present invention.
Figure 4:
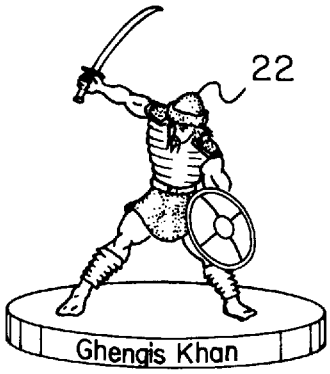
FIG. 4 is a schematic view a ruler of the present invention.
Figure 5:
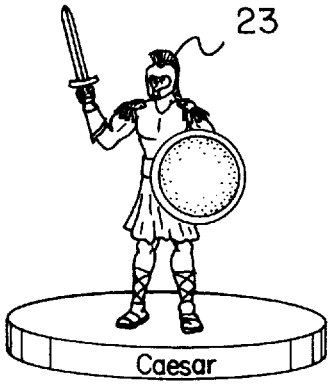
FIG. 5 is a schematic view a ruler of the present invention.
Figure 6:
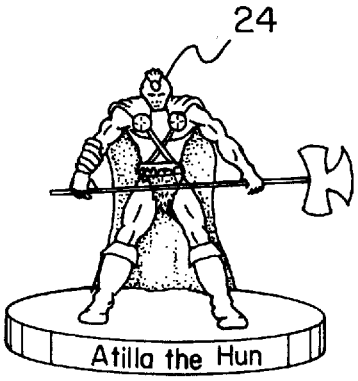
FIG. 6 is a schematic view a ruler of the present invention.
Figure 7:
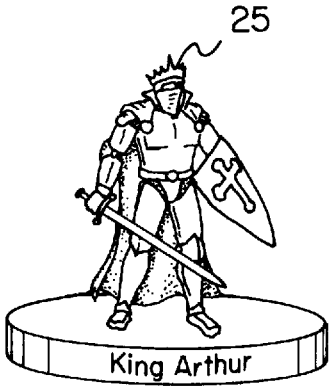
FIG. 7 is a schematic view a ruler of a new wargame playing system according to the present invention.
Figure 8:
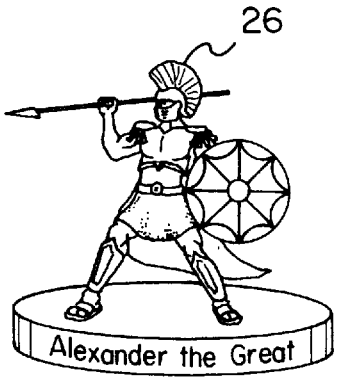
FIG. 8 is a schematic view a ruler of the present invention.
Figure 9:
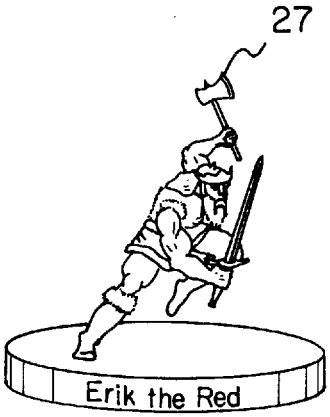
FIG. 9 is a schematic view a ruler of the present invention.
Figure 10:
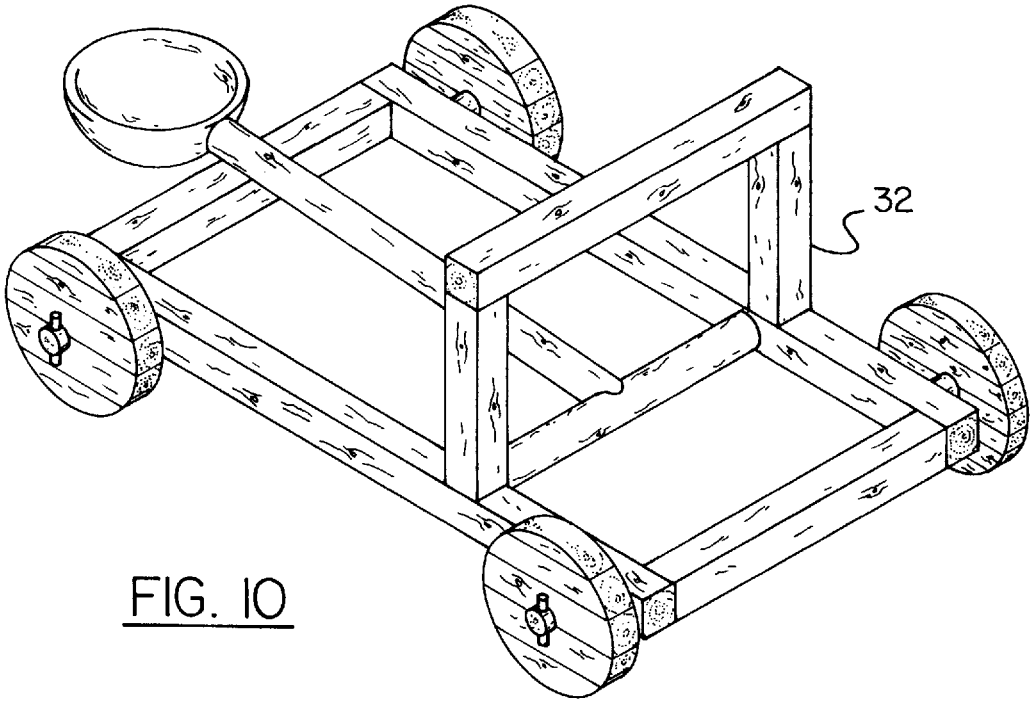
FIG. 10 is a schematic perspective view of a catapult playing piece of the present invention.
Figure 11:
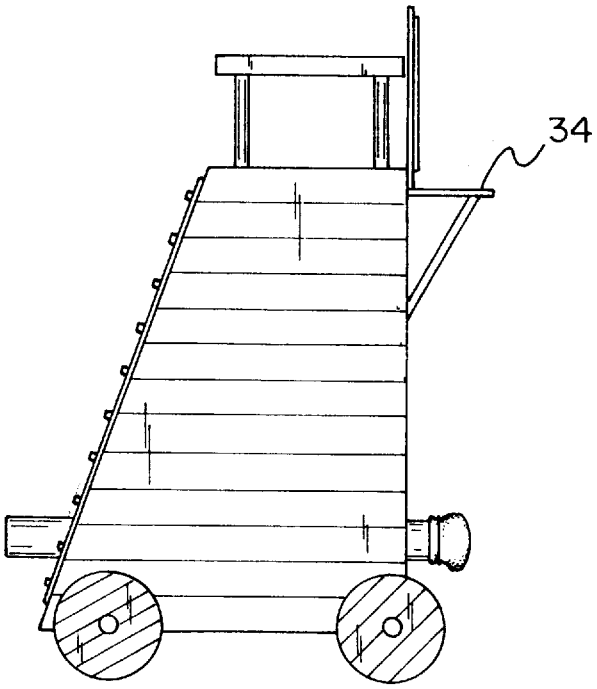
FIG. 11 is a schematic side view of a siege tower of a new wargame playing system according to the present invention.
Figure 18:
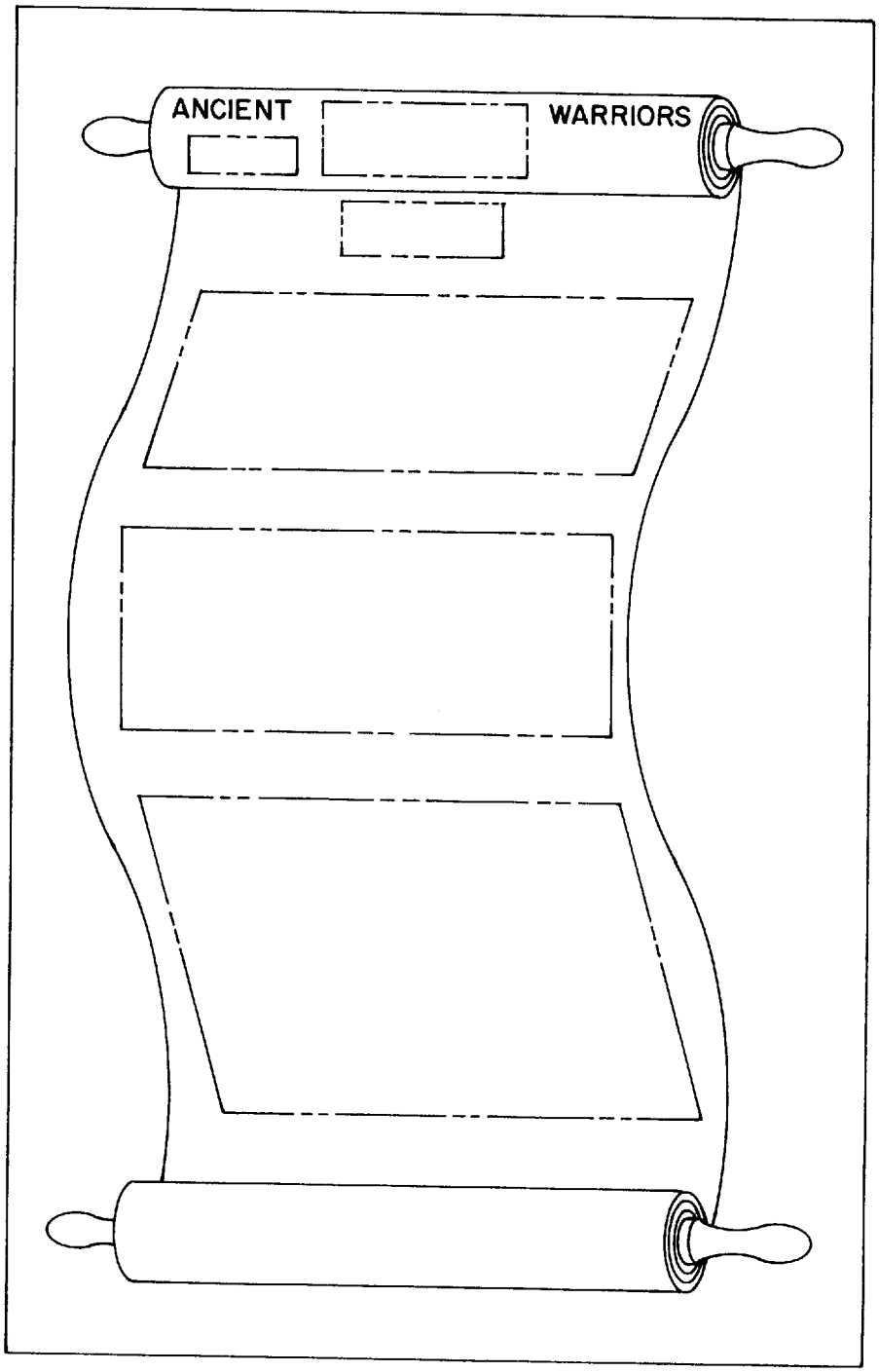
FIG. 18 is a schematic side view of a description sheet which is used for providing information about an army and culture represented in one of the playing sets.
Figure 19:
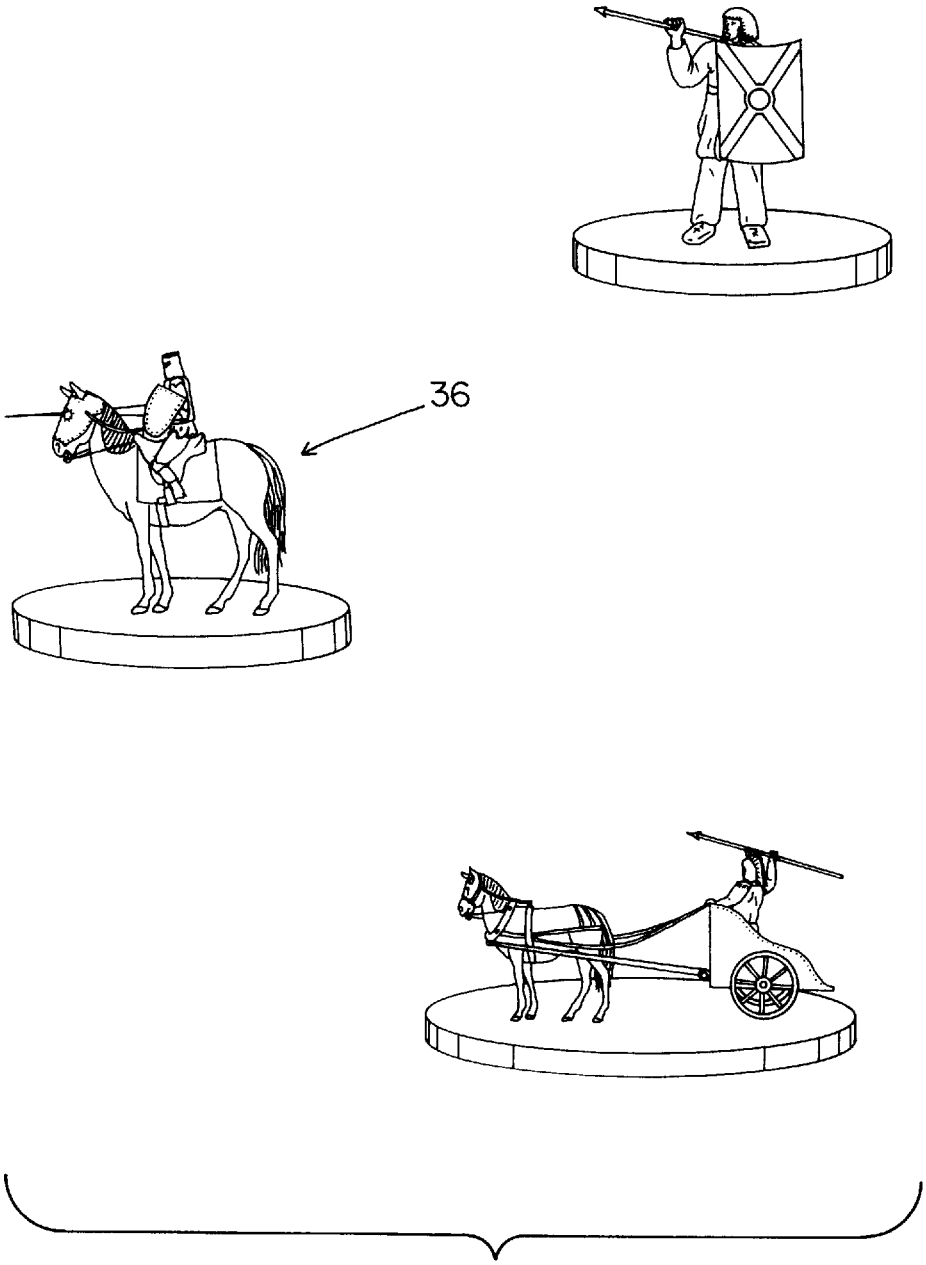
FIG. 19 is a schematic side view of various soldier pieces of a new wargame playing system according to the present invention.

With reference FIGS. 3 and 18, the game system preferably includes a set of quest cards. Each of the quest cards has at least one question thereon. The question has a corresponding correct answer. Only the player whose quest question is asked may answer and any other person who answers or aids in the answer will lose a gold coin or the equivalent of the same. The player is allowed 30 seconds to answer their quest card question, if in the time allowed the question is not answered or answered incorrectly, then the player who asked the question is given the coins the other player on the quest would have won. Upon the answer being given or time elapsed, the reader shall display the card for all to read and view. The card is then placed at the bottom of the pile of the quest cards upside down to separate the unused from the used cards, when all cards have been used, simply reshuffle all the cards and continue to play. Remember, the player whose turn it is whether he or she answered correctly or failed their quest shall continue their movement of their pieces or roll of the dice. When a player correctly answers the question of the quest card, the player receives a predetermined number of playing coins as a reward.

Figure 14:
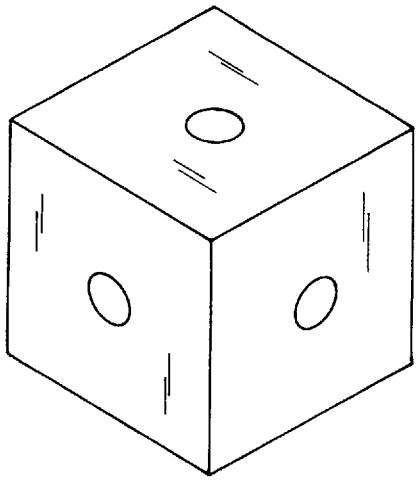
FIG. 14 is a schematic perspective view of a die of the present invention.
Figure 15:
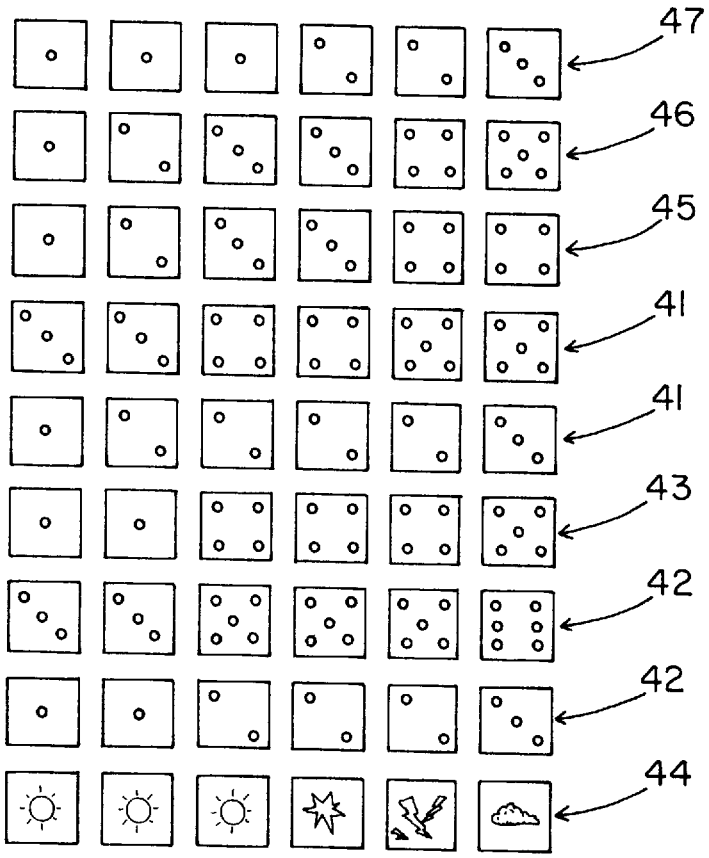
FIG. 15 is a schematic view of the dice sets of the present invention.

The game system also includes a plurality of dice divided into a number of dice sets (FIGS. 14 and 15). The dice sets include: (1) a movement set of dice for determining the movement of a piece of the playing sets; (2) a defender damage set of dice for determining the amount of damage sustained by a piece of the playing set designated as a defender; (3) an attacker damage set of dice for determining the amount of damage sustained by a piece of the playing set designated as an attacker; (4) a weather set of dice for representing a number of types of weather, each of the weathers affecting the movement of the pieces of the playing piece sets; (5) a bonus die for determining the amount of bonus during a combat; (6) a silver die for determining the number of silver playing coins a player will receive; and (7) a gold die for determining the number of gold playing coins a player will receive.

In playing the game system, the object of the game is to either eliminate your opponents' armies and their ruler piece or by capturing your opponents' pieces and force your opponents to use up all their coins and force their ruler piece to surrender. Each piece is worth a designated amount of coins and when captured the capturing army may ransom the pieces off at double the amount of what they are worth to the army that lost the pieces. The only piece that cannot be held for ransom is the ruler pieces of their army. Additionally, if a player captures another player's pieces rather than defeating them in battle and the ruler piece is forced to surrender to that victorious player, the victorious player may use the captured pieces and use the captured pieces as a second army. The other players who have pieces of that army may still hold them for ransom from the player who has acquired this new army. The player who makes the ruler piece surrender shall obtain all existing pieces on the field that belonged to the surrendering ruler piece's army.

In setting up the game, the object is to protect the ruler piece and queen of an army. Only the ruler piece may capture another ruler piece, but any piece of a player's army may capture the queens of another army. To begin the set up of the game, each player must select their ruler piece and their army and which player goes first. One of the player is then established to be a banker for distributing playing pieces and the coins. Preferably, the player who is last shall act as banker and disperse pieces sold and the pieces that are killed in battle. The banker then distributes to each player a number of gold playing coins and a number of silver playing coins. The player who moves first shall pick which end he or she wishes to start from on the battle field, and then the player on his or her left shall proceed next and so on. The first player shall purchase his or her army first. Each player must use at least half of their coins, both gold and silver on their first turn in buying their army. The next and all proceeding players shall do the same. It is important to note that all players may only buy their pieces to build their army and ransom them back on their own particular turn. Each player then places their purchased pieces on the playing surface of the game board. Preferably, each player places their purchased pieces on a space on the playing surface of the game board located at a corner of the grid of spaces.

Preferably, the game board has a plurality of starting zones which act as the base camp for queen of a player. The queen may never leave the zone, except when her ruler has captured an opponent's zone and has captured the ruler of that zone. Then, the queen may move to that red zone. If a player captures an opponent's zone and occupies all of their squares in the zone, then that player may then additionally use that zone to place new pieces of your army as well as that of the captured army.

The game is played through a series of player turns, with each player performing a player turn. Each player turn first comprises the rolling the movement set of dice and the weather set of dice. Preferably, the player moving first rolls the movement set of dice and the weather set of dice before the other players to determine the effect the weather has on movement. The player's pieces placed on the playing surface are then moved of a set a number of spaces on the playing surface. The number of spaces being determined by the roll of the movement set of dice and the weather set of dice. A player may move some or all of their associated pieces placed on the board. If quest cards are being used, a quest card is then drawn from the set of quest cards and the player of the player turn must attempt to answer a question provided on the drawn quest card. If the player correctly answers the posed question, the player then receives a predetermined number of the playing coins. Preferably, this determination is made by rolling the gold die and the silver die to determine the number of playing coins awarded to a player. The award of the playing coins ends that player turn. The next player may now proceed as the first player did each and every time.

After each player has moved their pieces and answered a quest card question, they may now at the beginning of their next turns buy, trade, ransom and exchange pieces and only at the beginning of each of his or her turn only. The only exception is after a battle has been decided and the looser of the battle needs to make an exchange to pay the winner his or her value won in that battle. If, on a player's next turn, that player moves in range of an enemy, the player may engage in attacking the enemy player being bordered (or if in range of the enemy with archers, launchers, or catapults). To attack an enemy player, a player must border them on the player's turn after the rolling of the movement and weather dice.

Once in range, a player may attack with their playing pieces, the playing pieces of another player (the playing pieces of the another player being located in a space on the playing surface adjacent a space on the playing surface occupied by at least one playing piece of the player of the associated player turn). In general, the steps of attacking the playing pieces of another player comprises first assigning an attacking player and a defending player. The attacker then declaring a battle between units of the attacker and units of the defender. A power value is then assigned for the units of the attacker in the battle and a power value is assigned for the units of the defender in the battle. Power tables may be used to determine which units may or may not attack each other and what units are unable to defend themselves. The power values are determined by the highest coin value unit of the associated player in the battle.

Next, the attacker rolls the attacker damage dice and then the defender rolls the defender damage dice after the attacker has rolled their associated dice. If possible, the attacker may use the bonus dice to add to their dice total. However, the attacker may roll the bonus dice only at the beginning of their turn, whereas the defender may roll their bonus dice each time they are attacked. A loser is declared having the lower sum of rolled dice. The difference between the dice will determine who wins and by what amount the dice difference indicate. The players then calculate the loss of value. The loss of value is calculated by subtracting the sum of the defender's rolled dice from the sum of the attacker's rolled dice to obtain a difference and then multiplying the difference by the power value of the defender. Battles are resolved as illustrated in the following examples:

EXAMPLE 1

In the event an attacking battle group attacks a weaker battle group and looses in the dice roll, the looser of the battle in this case would be the attacking battle group and must give to the Banker one of his or her weakest units or units depending on how many they lost by in the difference in the dice. However, if the attacker, for example, has a chariot in their space and attacks a group of infantry consisting of only 2 infantry units and looses the dice battle, then the attacker who has lost must pay tribute to the winner of the battle in silver coins the difference they lost in the dice battle and then must retreat the amount of spaces they paid in silver coins to the victor of the battle. If the attacker can not move back the required spaces the must not only pay tribute but now surrender to the defender his chariot unit or units.

EXAMPLE 2

When, for example, a combined force of cavalry, infantry, archer and chariots attack a defender of the same strength, and the dice dictate that the attacker has won by 2 units, the loser must pay the total of 20 units due to the chariots vale in their group. If say an attacker has 2 chariots and attacks the defender who has 1 chariot and 1 cavalry unit and the defender losses the battle of the dice, the loser or defender in this case must give to the banker 1 chariot unit and his cavalry unit to add up to 20 units. This is due to the fact that the defender's highest value is a chariot worth 10 units and since the defender's highest ranking piece establishes the power value and the defender looses he or she must give up the chariot multiplied by 2 dice factors or 20 units. If the dice dictate that the defender wins by 2 units, in the dice roll, the attacker would give up 2 chariots or 20 units in value. If on the other hand the defender looses by 3 or even 5 dice units, the defender would loose as many if not all of his or her units in that square to pay the banker.

EXAMPLE 3

If infantry attacks and no matter the amount on either side, who ever looses the dice battle shall give up as many units as dictated by the dice difference.

EXAMPLE 4

If a chariot attacks 10 (which is equal to the value of the chariot's value) infantry units in a battle group and the chariot or attacker looses the dice battle, the chariot lost in battle and must now retreat and pay tribute to the winner in silver coins because he or she did not have the small enough units to loose so they must retreat in shame and pay for their bad judgment, this is because the defender determines the power of battle value with its infantry unit being the defenders highest ranking unit in that square or battle group. If, on the other hand, the attacker with his chariot wins the dice battle against the 10 infantry units, the defender with his 10 infantry units will lose 2 units in that square, this is because the defender fought on his infantry value level.

EXAMPLE 5

All battles are determined by the roll of the dice and are by the defenders strongest unit in a group in the square it occupies. For example: a battle group comprising of 1 chariot, 1 Calvary unit, 2 archer units, and 3 infantry units is attacking a defender with a battle group of 2 Calvary units and 4 infantry units. The attacker rolls a total of 5 on their battle dice and the defender rolls a total of 7 on their dice. The attacker is the looser by a total value of 5 units per point value of the dice difference between the attack and the defense dice. So in this case, the defender has the highest total of value of the units with a cavalry unit (worth 5 value units) with a total battle dice favoring the defender by a difference of 2 units. Therefore, (because the defender determines the value of power being 5 units, due to the presence of a cavalry) the attacker must give double (2×) the value or 10 of units in that group. For example, the attacker may gives to the banker 10 units of value (most likely he or she would give up the cavalry unit (5 units of value) and two archer units (2 units of value each and for a total of 4 units) and 1 infantry unit (1 unit of value)). These units would equal the losses the attacking or the defeated battle group would suffer.

A unit may be captured if the unit cannot retreat to another space. A captured unit may be ransomed to another player for a number of playing coins. A king may not be captured unless the king is the only unit left of the looser. In the even a Queen is attacked and defeated (note: must destroy or capture her complete battle group in order to capture her), she is automatically captured and may be held for ransom but for no more than double the amount she is worth.

To finish the game one army must defeat all the other armies or capture all the other leaders armies. A player must have their queen and the starting region in order to conquer an opponent's leader and to capture his or her army and make them your own. To conquer a ruler, a player must defeat the opposing ruler in battle and destroy his battle group, unless the ruler is alone and has no other units to loose.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game system, comprising the steps of:

providing a game board having a playing surface being illustrated to represent terrain and having a plurality of spaces, each said space having a type of terrain represented therein;

providing a plurality of gold playing coins and a plurality of silver playing coins;

providing a plurality of playing piece sets, each said playing piece set comprising:

a ruler piece;

a queen piece;

a plurality of soldier pieces; and wherein each piece of said playing piece set being assigned an associated coin value, said coin values determining the number of playing coins required to purchase its respective piece of said playing piece set;

providing a plurality of siege pieces, said siege pieces including catapults, a battering ram, an assault tower, and a bridge providing a plurality of dice, said dice being divided into a number of dice sets, wherein said dice sets include:

a movement set of dice for determining the movement of a piece of said playing sets;

a defender damage set of dice for determining the amount of damage sustained by a piece of said playing set designated as a defender;

an attacker damage set of dice for determining the amount of damage sustained by a piece of said playing set designated as an attacker;

a weather set of dice for representing a number of types of weather, each of said weathers affecting the movement of said pieces of said playing piece sets a bonus die for determining the amount of bonus during a combat;

a silver die for determining the number of silver playing coins a player will receive;

a gold die for determining the number of gold playing coins a player will receive;

providing a plurality of players;

assigning each player a playing piece set;

establishing one of said player to be a banker for distributing playing pieces and said coins;

determining which player moves first;

distributing a number of gold playing coins and a number of silver playing coins to each said player;

each player purchasing pieces from their associated playing piece set with said playing coins in their possession;

each player placing their purchased pieces on said playing surface of said game board, wherein each player places their purchased pieces on a space on said playing surface of said game board located at a corner of said grid of spaces;

each player performing a player turn, each said player turn comprising;

said rolling said movement set of dice and said weather set of dice, wherein said player moving first rolls said movement set of dice and said weather set of dice before said other players;

moving pieces placed on the playing surface of a set a number of spaces on said playing surface, said number of spaces being determined by said roll of said movement set of dice and said weather set of dice, wherein each player may move some or all of their associated pieces placed; and attacking the playing pieces of another player, said playing pieces of said another player being located in a space on said playing surface adjacent a space on said playing surface occupied by at least one playing piece of said player of the associated player turn.

2. The method of claim 1, wherein said plurality of spaces of said game board are arranged in a grid fashion having a plurality of columns and rows, each said space having a type of terrain represented therein, and wherein said spaces are generally rectangular.

3. The method of claim 1, further comprising the step of:

providing a treasure chest and a plurality of player chests, said chests being for holding playing coins therein.

4. The method of claim 1, wherein said soldier pieces provided include infantry pieces, cavalry pieces, chariot pieces, and archer pieces, wherein said soldier pieces include a number of elephant pieces.

5. The method of claim 1, further comprising the step of providing a set of quest cards, wherein each of said quest cards having at least one question thereon, said question having a corresponding correct answer, wherein a player answering said question of said respective quest card with said correct answer receives a predetermined number of playing coins.

6. The method of claim 5, further comprising the steps of:

drawing a quest card from said set of quest cards;

answering a question provided on said drawn quest card, wherein a player correctly answering said posed question receives a predetermined number of said playing coins; and determining a number of playing coins awarded to a player, wherein rolling said gold die and said silver die to determine the number of playing coins awarded to a player, wherein said award of said playing coins ends said player turn.

7. The method of claim 1, wherein each of said terrain types in an associated space limiting occupation of the particular terrain type by particular pieces of said playing piece set.

8. The method of claim 1, further comprising the step of ransoming playing pieces captured in a battle to another player.

9. The method of claim 1, wherein the step of attacking the playing pieces of another player comprises:

assigning an attacking player and a defending player;

said attacker declaring a battle between units of said attacker and units of said defender;

assigning a power value for the units of the attacker in the battle;

assigning a power value for the units of the defender in the battle;

wherein said power values are determined by the highest coin value unit of the associated player in the battle;

said attacker rolling said attacker damage dice;

said defender rolling said defender damage dice after said attacker has rolled their associated dice;

declaring a loser, said loser having the lower sum of rolled dice;

calculating the loss of value, said loss of value being calculated by subtracting the sum of the defender's rolled dice from the sum of the attacker's rolled dice to obtain a difference and then multiplying said difference by said power value of said defender;

said looser paying said banker units from the battle having a point value sum equal to the loss value;

wherein a loser not having sufficient units in a battle to pay said banker loses all of their units involved in said battle;

wherein a loser retreats at least one space if said loser is an attacker and said loser does not have any units of a small enough value to pay the banker for the loss, said space retreated to being unoccupied by any other player's units;

wherein a unit may be captured if said unit cannot retreat to another space;

wherein a captured unit may be ransomed to another player for a number of playing coins; and wherein a king may not be captured unless said king is the only unit left of the loser.

10. A method of playing a game system, comprising the steps of:

providing a game board having a playing surface being illustrated to represent terrain and having a plurality of spaces being arranged in a grid fashion having a plurality of columns and rows, each said space having a type of terrain represented therein, said spaces being generally rectangular;

providing a treasure chest and a plurality of player chests, said chests being for holding playing coins therein;

providing a plurality of gold playing coins and a plurality of silver playing coins;

providing a plurality of playing piece sets, each said playing piece set comprising:

a ruler piece;

a queen piece;

a plurality of soldier pieces, said soldier pieces including infantry pieces, cavalry pieces, chariot pieces, and archer pieces, wherein said soldier pieces include a number of elephant pieces; and wherein each piece of said playing piece set being assigned an associated coin value, said coin values determining the number of playing coins required to purchase its respective piece of said playing piece set;

providing a plurality of siege pieces, said siege pieces including catapults, a battering ram, an assault tower, and a bridge providing a set of quest cards, wherein each of said quest cards having at least one question thereon, said question having a corresponding correct answer, wherein a player answering said question of said respective quest card with said correct answer receives a predetermined number of playing coins, providing a plurality of dice, said dice being divided into a number of dice sets, wherein said dice sets include:

a movement set of dice for determining the movement of a piece of said playing sets;

a defender damage set of dice for determining the amount of damage sustained by a piece of said playing set designated as a defender;

an attacker damage set of dice for determining the amount of damage sustained by a piece of said playing set designated as an attacker;

a weather set of dice for representing a number of types of weather, each of said weathers affecting the movement of said pieces of said playing piece sets a bonus die for determining the amount of bonus during a combat;

a silver die for determining the number of silver playing coins a player will receive;

a gold die for determining the number of gold playing coins a player will receive;

wherein each of said terrain types in an associated space limiting occupation of the particular terrain type by particular pieces of said playing piece set;

providing a plurality of players;

assigning each player a playing piece set;

establishing one of said players to be a banker for distributing playing pieces and said coins;

determining which player moves first;

distributing a number of gold playing coins and a number of silver playing coins to each said player;

each player purchasing pieces from their associated playing piece set with said playing coins in their possession;

each player placing their purchased pieces on said playing surface of said game board, wherein each player places their purchased pieces on a space on said playing surface of said game board located at a corner of said grid of spaces;

each player performing a player turn, each said player turn comprising;

said rolling said movement set of dice and said weather set of dice, wherein said player moving first rolls said movement set of dice and said weather set of dice before said other players;

moving pieces placed on the playing surface of a set a number of spaces on said playing surface, said number of spaces being determined by said roll of said movement set of dice and said weather set of dice, wherein each player may move some or all of their associated pieces placed;

drawing a quest card from said set of quest cards;

answering a question provided on said drawn quest card, wherein a player correctly answering said posed question receives a predetermined number of said playing coins;

determining a number of playing coins awarded to a player, wherein rolling said gold die and said silver die to determine the number of playing coins awarded to a player, wherein said award of said playing coins ends said player turn;

ransoming playing pieces captured in a battle to another player;

attacking the playing pieces of another player, said playing pieces of said another player being located in a space on said playing surface adjacent a space on said playing surface occupied by at least one playing piece of said player of the associated player turn;

wherein attacking the playing pieces of another player comprises:

assigning an attacking player and a defending player;

said attacker declaring a battle between units of said attacker and units of said defender;

assigning a power value for the units of the attacker in the battle;

assigning a power value for the units of the defender in the battle;

wherein said power values are determined by the highest coin value unit of the associated player in the battle;

said attacker rolling said attacker damage dice;

said defender rolling said defender damage dice after said attacker has rolled their associated dice;

declaring a loser, said loser having the lower sum of rolled dice;

calculating the loss of value, said loss of value being calculated by subtracting the sum of the defender's rolled dice from the sum of the attacker's rolled dice to obtain a difference and then multiplying said difference by said power value of said defender;

said looser paying said banker units from the battle having a point value sum equal to the loss value;

wherein a loser not having sufficient units in a battle to pay said banker loses all of their units involved in said battle;

wherein a loser retreats at least one space if said loser is an attacker and said loser does not have any units of a small enough value to pay the banker for the loss, said space retreated to being unoccupied by any other player's units;

wherein a unit may be captured if said unit cannot retreat to another space;

wherein a captured unit may be ransomed to another player for a number of playing coins; and wherein a king may not be captured unless said king is the only unit left of the loser.

* * * * *